US008662184B2

(12) United States Patent
June

(10) Patent No.: US 8,662,184 B2
(45) Date of Patent: Mar. 4, 2014

(54) MULTI-SECTION TREE COMPLETION SYSTEM

(75) Inventor: David R. June, Houston, TX (US)

(73) Assignee: Cameron International Corporation, Houston, TX (US)

( * ) Notice: Subject to any disclaimer, the term of this patent is extended or adjusted under 35 U.S.C. 154(b) by 527 days.

(21) Appl. No.: 12/922,897

(22) PCT Filed: Apr. 15, 2009

(86) PCT No.: PCT/US2009/040665

§ 371 (c)(1),
(2), (4) Date: Sep. 16, 2010

(87) PCT Pub. No.: WO2009/129307

PCT Pub. Date: Oct. 22, 2009

(65) Prior Publication Data

US 2011/0017467 A1 Jan. 27, 2011

Related U.S. Application Data

(60) Provisional application No. 61/045,133, filed on Apr. 15, 2008.

(51) Int. Cl.
*E21B 43/01* (2006.01)

(52) U.S. Cl.
USPC ..... 166/368; 166/338; 166/344; 166/348; 166/360; 166/378; 285/123.1

(58) Field of Classification Search
USPC ..... 166/368, 338–341, 344, 348, 360, 369, 166/373–375, 378–380, 88.1; 285/123.1
See application file for complete search history.

(56) References Cited

U.S. PATENT DOCUMENTS

| | | | | | |
|---|---|---|---|---|---|
| 4,681,133 | A * | 7/1987 | Weston | 137/315.18 |
| 4,703,807 | A * | 11/1987 | Weston | 166/373 |
| 4,804,045 | A * | 2/1989 | Reed | 166/65.1 |
| 5,544,707 | A * | 8/1996 | Hopper et al. | 166/382 |
| 5,992,527 | A * | 11/1999 | Garnham et al. | 166/379 |
| 6,062,314 | A * | 5/2000 | Nobileau | 166/368 |
| 6,076,605 | A * | 6/2000 | Lilley et al. | 166/368 |
| 6,082,460 | A * | 7/2000 | June | 166/348 |
| 6,302,212 | B1 * | 10/2001 | Nobileau | 166/368 |
| 6,805,200 | B2 * | 10/2004 | DeBerry | 166/347 |

(Continued)

OTHER PUBLICATIONS

PCT/US2009/040665 International Search Report and Written Opinion, Oct. 28, 2009 (11 p.).

*Primary Examiner* — Matthew Buck
(74) *Attorney, Agent, or Firm* — Chamberlain Hrdlicka

(57) ABSTRACT

A subsea well production system for a well including a subsea wellhead. The system includes a multi-section production tree that includes a landing section engageable with the subsea wellhead and including a landing section bore. The tree also includes a valve section separate from and engageable with the landing section, the valve section including a lateral production port extending through a valve section wall and in communication with a valve section bore. A production tubing supported by a tubing hanger is installed and supported in the landing section bore such that the tubing hanger extends into the valve section bore. The tubing hanger and production tubing are retrievable through the section bores without disengaging the valve section from the landing section. The valve section is also disengageable from the landing section with the tubing hanger remaining in the landing section.

28 Claims, 8 Drawing Sheets

(56) References Cited

U.S. PATENT DOCUMENTS

| | | | | |
|---|---|---|---|---|
| 6,942,028 | B2 * | 9/2005 | Hosie | 166/88.4 |
| 6,978,839 | B2 * | 12/2005 | Fenton et al. | 166/348 |
| 6,988,553 | B2 * | 1/2006 | DeBerry | 166/347 |
| 7,093,660 | B2 * | 8/2006 | Hopper et al. | 166/348 |
| 7,096,937 | B2 * | 8/2006 | Bartlett et al. | 166/86.2 |
| 7,117,945 | B2 * | 10/2006 | Hopper et al. | 166/348 |
| 7,331,396 | B2 * | 2/2008 | Reimert et al. | 166/368 |
| 7,647,974 | B2 * | 1/2010 | Fenton | 166/368 |
| 7,909,103 | B2 * | 3/2011 | Fenton | 166/348 |
| 8,157,015 | B2 * | 4/2012 | Voss et al. | 166/368 |
| 2004/0188083 | A1 | 9/2004 | Bartlett et al. | |
| 2007/0246220 | A1 | 10/2007 | Fenton | |

* cited by examiner 10
16
52
54
26
46
62
44
34
48
18
64
14
58
60
66
18
12

84
16
10
52
80
82
50
54
26
46
20
62
44
40
24
42
34
38
48
18
32
58
14
30
60
28
22
66
18
36
12

MULTI-SECTION TREE COMPLETION SYSTEM

CROSS-REFERENCE TO RELATED APPLICATIONS

This application is a 35 U.S.C. §371 national stage application of PCT/US2009/040665 filed Apr. 15, 2009, which claims the benefit of U.S. Provisional Patent Application No. 61/045,133 filed Apr. 15, 2008, both of which are incorporated herein by reference in their entireties for all purposes.

STATEMENT REGARDING FEDERALLY SPONSORED RESEARCH OR DEVELOPMENT

Not Applicable.

BACKGROUND

A well capable of producing oil or gas that is deep enough will typically have a well structure to provide support for the borehole and isolation capabilities for different formations. Typically, the well structure includes an outer structure, such as a conductor housing at the surface, that is secured to conductor pipe that extends a short depth into the well. A wellhead housing is landed in the conductor housing with an outer or first string of casing extending from the wellhead and through the conductor to a deeper depth into the well. Depending on the particular conditions of the geological strata above the target zone (typically, either an oil or gas producing zone or a fluid injection zone), one or more additional casing strings (e.g., production casing, casing, tubing, production tubing, etc.) will extend through the outer string of casing to increasing depths until the well is cased to its final depth. Each string of casing is supported at the upper end by a casing hanger that lands in and is supported by the wellhead housing, each set above the previous one. Between each casing hanger and the wellhead housing, a casing hanger seal assembly is set to isolate each annular space between strings of casing. The last, and innermost, string of casing extends into the well to the final depth and is referred to as the production casing. The strings of casing between the outer casing and the production casing are typically referred to as intermediate casing strings.

When drilling and running strings of casing in the well, it is critical that the operator maintain pressure control of the well. This is accomplished by establishing a column of fluid with predetermined fluid density inside the well that is circulated down into the well through the inside of the drill string and back up the annulus around the drill string to the surface, for example. This column of density-controlled fluid balances the downhole pressure in the well. A blowout preventer system (BOP) is also used to as a safety system to ensure that the operator maintains pressure control of the well. The BOP is located above the wellhead housing and is capable of shutting in the pressure of the well, such as in an emergency pressure control situation.

After drilling and installation of the casing strings, the well is completed for production by installing a string of production tubing that extends to the producing zone within the production casing, for example. Perforations are made in the production casing to allow fluids to flow from the formation into the productions casing at the producing zone. At some point above the producing zone, a packer seals the space between the production casing and the production tubing to ensure that the well fluids flow through the production tubing to the surface. The tubing is supported by a tubing hanger assembly that lands and locks above the production casing hanger.

Various arrangements of production control valves are arranged at the wellhead in an assembly generally known as a tree, which is generally either a vertical tree or a horizontal tree. With a vertical tree, after the production hanger and production tubing are installed in the wellhead housing, the BOP is removed and the vertical tree is locked and sealed onto the wellhead. The vertical tree has one or more production bores containing actuated valves that extend vertically to the respective lateral production fluid outlets in the vertical tree. The production bores and production valves are thus in-line with the production tubing.

With a vertical tree, the tree may be removed while leaving the completion (the production tubing and hanger) in place. However, if it is necessary to pull the completion, the vertical tree must be removed and replaced by a BOP, which involves setting and testing plugs or relying on downhole valves, which may be unreliable by not having been used or tested for a long time. Moreover, removal and installation of the tree and BOP assembly generally requires robust lifting equipment, such as a rig, that have high daily rental rates, for instance. The well is also in a vulnerable condition while the vertical tree and BOP are being exchanged and neither of these pressure-control devices is in position, which is a lengthy operation that usually involves plugging and/or killing the well.

Instead of vertical trees, trees with the arrangement of production control valves offset from the production tubing, generally called horizontal trees, can be used. One type of horizontal tree is a Spool Tree™ which is shown and described in U.S. Pat. No. 5,544,707, hereby incorporated herein by reference for all purposes. A horizontal tree also locks and seals onto the wellhead housing; but the tubing hanger, instead of being located in the wellhead, locks and seals in the tree bore. After the tree is installed, the tubing string and tubing hanger are run into the tree using a tubing hanger running tool. The production port extends through the tubing hanger and seals prevent fluid leakage and production fluid flows into the corresponding production port in the tree. A locking mechanism above the production seals locks the tubing hanger in place in the tree. With the production valves offset from the production tubing, the production tubing hanger and production tubing may be removed from the tree without having to remove the horizontal tree from the wellhead housing. A problem with horizontal trees, however, is that if the tree needs to be removed, the entire completion must also be removed, which takes considerable time and also involves setting and testing plugs or relying on downhole valves, which may be unreliable by not having been used or tested for a long time. Additionally, because the locking mechanism on the tubing hanger is above and blocks access to the production port seals, the entire completion must be pulled, should the seals requiring servicing.

To manage expected maintenance costs, which are especially high for an offshore well, an operator typically selects equipment best suited for the type of maintenance he or she expects will be required. For example, a well operator must predict whether there will be a greater need in the future to pull the tree from the well for repair, or pull the completion, either for repair or for additional work in the well. Depending on the predicted maintenance events, an operator must decide whether the horizontal or vertical tree, each with its own advantages and disadvantages, is best suited for his or her purpose. For instance, with a vertical tree, it is more efficient to pull the tree and leave the completion in place. However, if the completion needs to be pulled, the tree must be pulled as well, increasing the time and expense of pulling the completion. Just the opposite is true for a horizontal tree, where it is more efficient to pull the completion, leaving the tree in place. However, if the tree needs to be pulled, the entire completion must be pulled as well, increasing the time and expense of pulling the tree. The life of the well could easily span 20 years and it is difficult to predict at the outset which capabilities are more desirable for maintenance over the life of the well. Thus, an incorrect prediction could greatly increase the cost of production over the life of the well.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
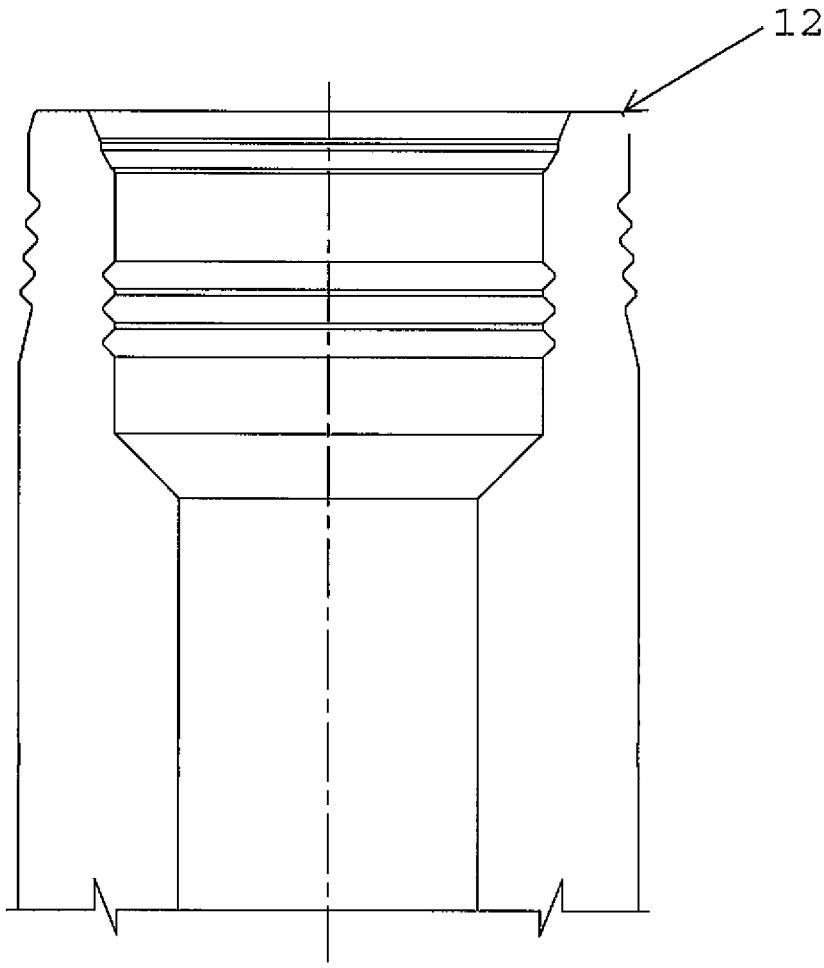
FIG. 1 is a cross section of a subsea wellhead for installation of the multi-section tree.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", form of the terms "connect", "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
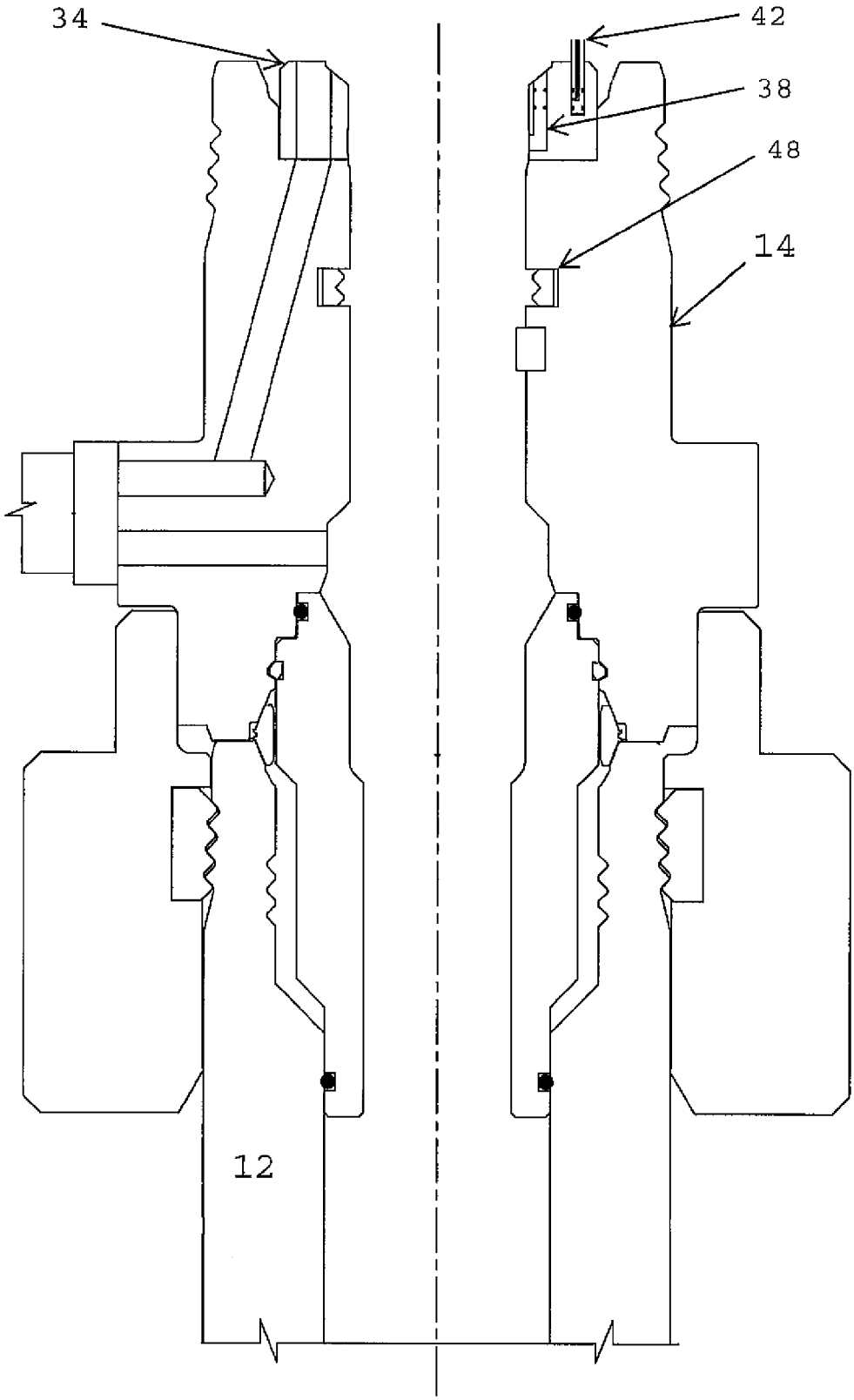
FIG. 2 is a cross section of the subsea wellhead and the landing section of the multi-section tree installed.
Figure 3:
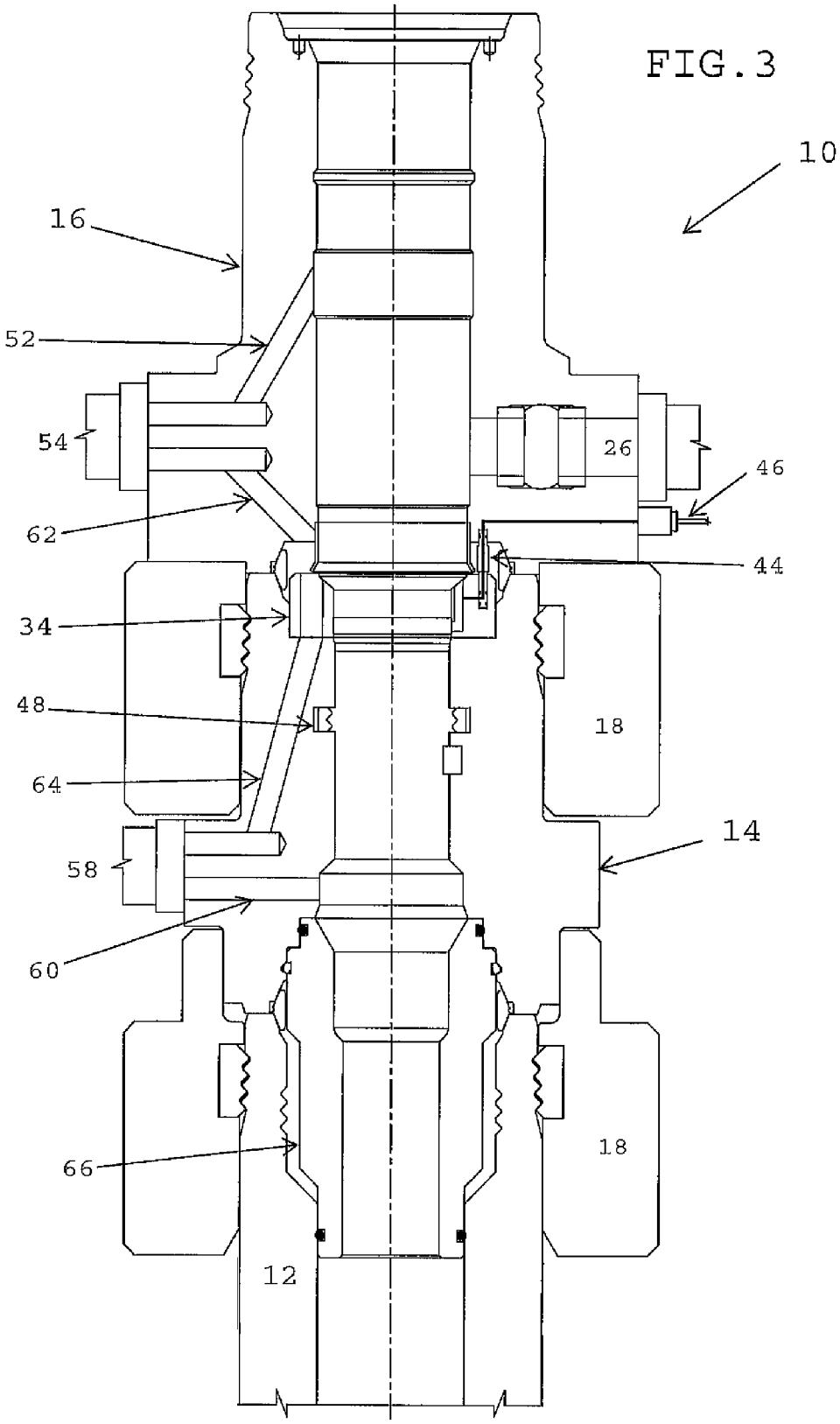
FIG. 3 is a cross-section of the multi-section tree with both tree sections installed without the completion.
Figure 4:
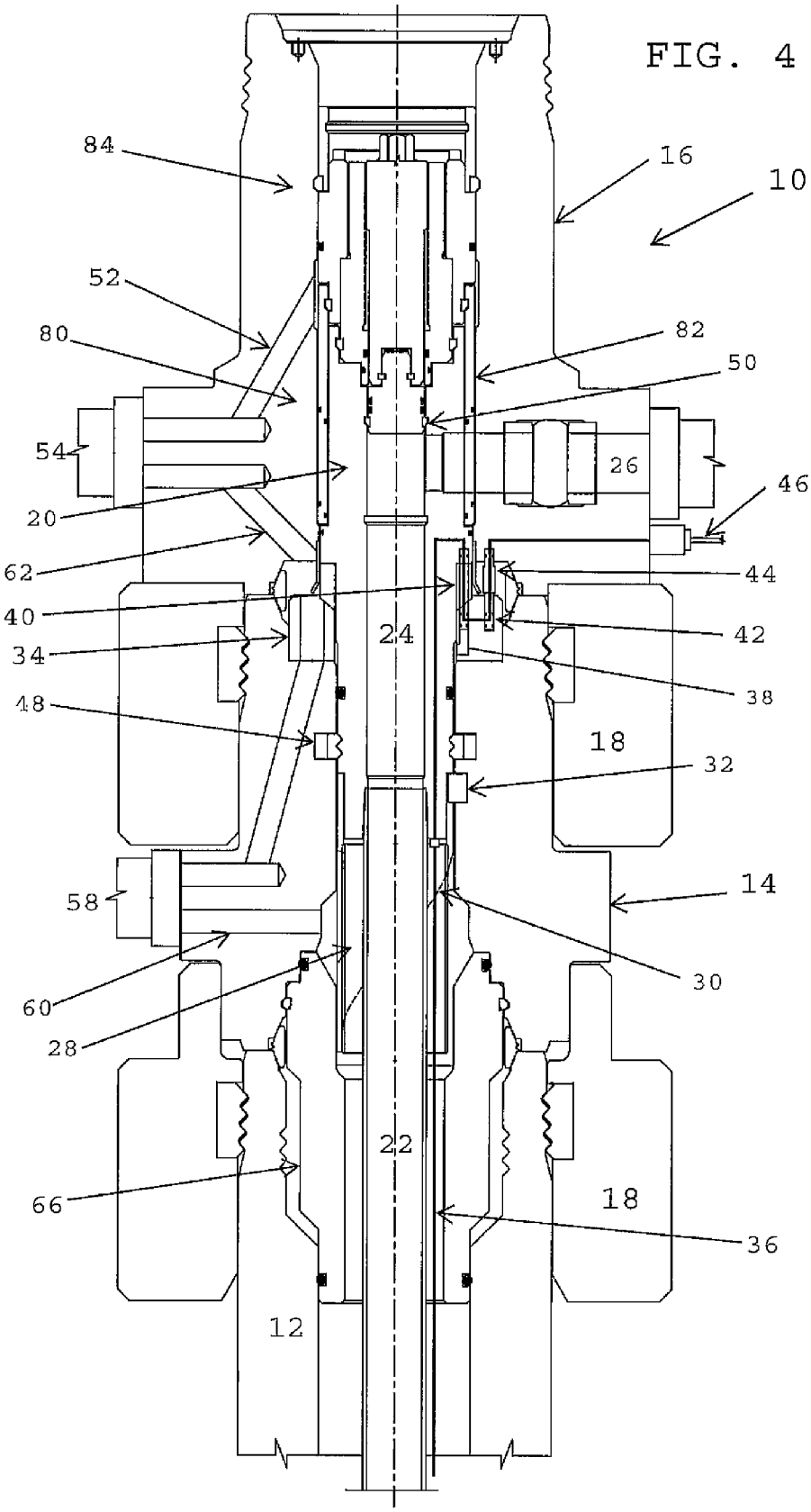
FIG. 4 is a cross-section of a multi-section tree with the landing section and the valve section and the completion installed on the subsea wellhead.

FIG. 1 illustrates a subsea wellhead 12 for installation of a multi-section tree 10 as shown in FIGS. 2-4, that includes a landing section 14 and a valve section 16. When the well is ready for completion, the landing section 14 and valve section 16 are lowered and installed onto the wellhead 12 using hydraulically operated collet connectors 18, with seals being formed by appropriate gaskets. Although not shown, appropriate valves for controlling fluid production from the multi-section tree 10 are located in or attached to the valve section 16. Also, though shown in FIGS. 2 and 3 as being installed separately, the landing section 14 and the valve section 16 may be connected on the surface and installed on the wellhead 12 at the same time.

Figure 5:
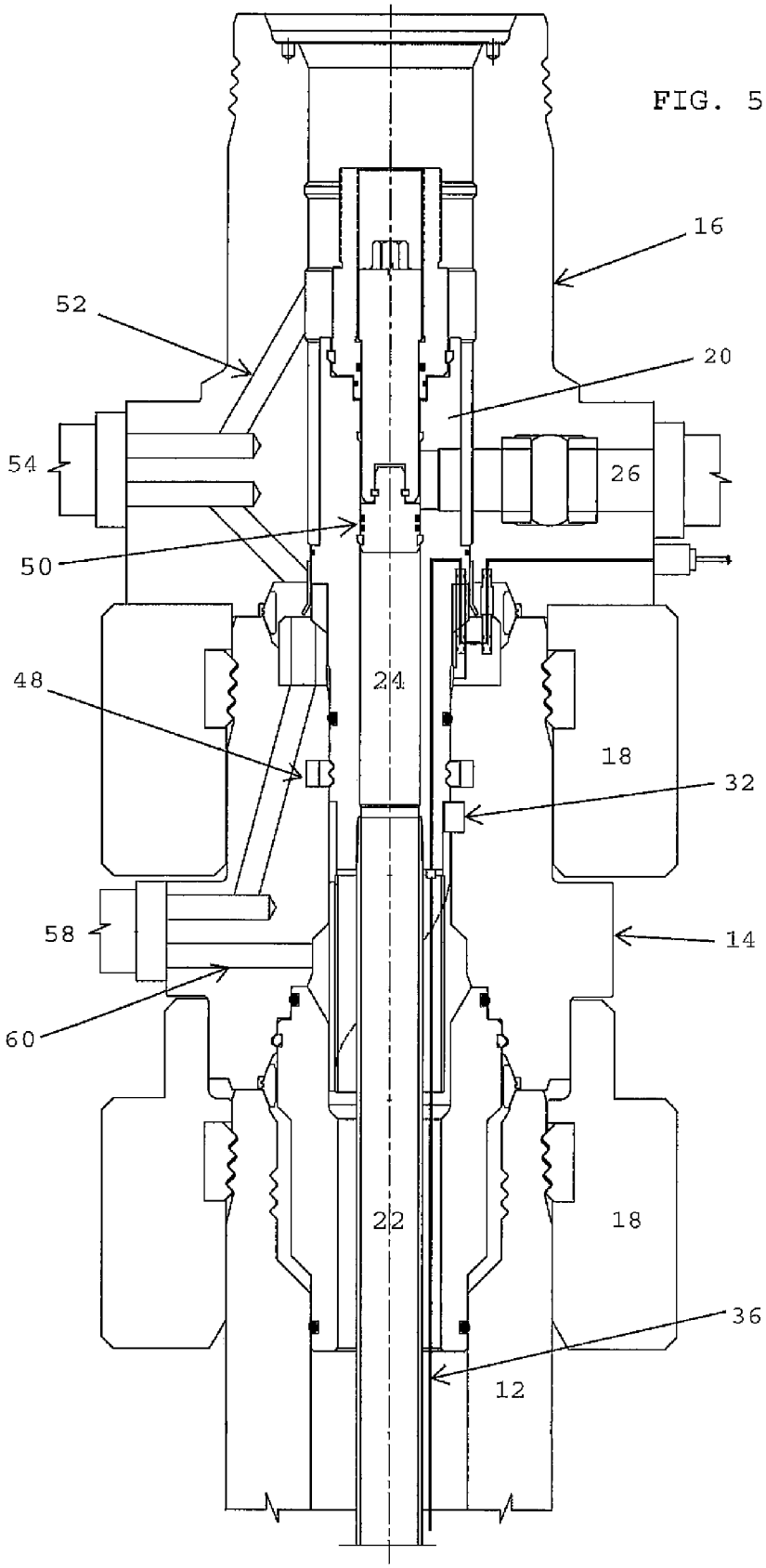
FIG. 5 is a cross-section of the multi-section tree with the tree cap and production seal assembly removed.

As shown in FIG. 5, the multi-section tree 10 is used for installing a completion that includes a tubing hanger 20 attached to and supporting the weight of a string of production tubing 22 extending below the tubing hanger 20 and into the well. The tubing hanger 20 includes an internal bore 24 aligned on one end with the bore of the production tubing 22. The other end of the internal bore 24 exits the tubing hanger 20 in alignment with a master production port 26 in the valve section 16 for producing well fluids to the surface.

When the well is ready for completion, appropriate plugs are set downhole from the wellhead 12 to maintain fluid pressure. The blowout preventer (BOP) and riser are then removed from the wellhead 12 and the multi-section tree 10 is installed either in separate sections or both sections at the same time. The BOP and riser are then reattached to the multi-section tree 10 and the plugs removed from the well using an appropriate tool run in through the riser. When installed, the multi-section tree 10 may be pressure tested to confirm the pressure integrity of the multi-section tree 10. A tubing hanger running tool (THRT) is then used to lower the completion, including the tubing hanger 20 and the production tubing 22, through the riser and land the tubing hanger 20 in the multi-section tree 10.

As shown in FIG. 4, there are fluid connections between the tubing hanger 20 and the multi-section tree 10. To align the tubing hanger 20 with the multi-section tree 10, and thus align the connections, a passive vertical orientation sleeve 28 is installed to the bottom of the tubing hanger 20. The orientation sleeve 28 also includes a ramp surface 30 that engages a key 32 on the inner surface of the landing section 14 to orient the tubing hanger 20. As the tubing hanger 20 lands in the multi-section tree 10, the engagement between the ramp surface 30 and the key 34 causes the tubing hanger 20 to rotate into position via a camming relationship therebetween. The tubing hanger 20 is thus aligned to its set position with the production tubing 22 extending through the orientation sleeve 28.

As shown in FIGS. 2-4, the multi-section tree 10 includes a fluid line connection adapter 34 between the landing section 14 and the valve section 16. Also, extending through the orientation sleeve 28 is a fluid line 36 that extends downhole to a surface-controlled subsurface safety valve (SCSSV) (not shown), which controls the flow of fluid through the production tubing 22 from the producing zone. The fluid line 36 extends from the SCSSV and into the tubing hanger 20 and routes into a passive coupler 40 that forms a fluid tight connection with an inlet fluid connector 38 in the adapter 34 when the tubing hanger 20 lands in the multi-section tree 10. Fluid may then route through the adapter 34 to an outlet connector 42 that is connected to a tree fluid line connector 44. From the tree fluid line connector 44, the fluid line routes through the valve section 16. Extending through the valve section 16, the tree fluid line is accessible from outside the multi-section tree 10 by a hydraulic control line 46 that extends to the surface.

When connected, the hydraulic control line 46 enables surface control of the SCSSV for well operations as discussed further below. The adapter 38 may alternatively be separated into two units that make the inlet connection in the landing section 14 and the outlet connection between the landing section 14 and the valve section 16 with a fluid line being routed in between through the landing section 14.

With the completion set in position, a lockdown actuator (not shown) actuates a locking mechanism 48 that engages a corresponding lock groove on the tubing hanger 20. The locking mechanism thus locks the tubing hanger 20 and the production tubing 22 in place within the multi-section tree 10. The lockdown actuator is located externally, internally, or a combination thereof in the multi-section tree 10 and may include an unlock override to unlock the locking mechanism 48. In the set position, the tubing hanger 20 seals against the inside wall of the multi-section tree 10 at various positions, including above and below the production port 26.

The seals above and below the production port 26 seal the interface between the internal bore 24 of the tubing hanger 20 and the production port 26. However, not all of the seals are necessary for every application. They may be located in different locations, not included at all, or have additional secondary barriers. Alternatively, the port 26 may be sealed to the port 24 directly, for example with a face seal, seal sub, or coupler. Additionally, these seals may be made from metal and/or non-metal composition depending on the performance characteristics needed.

With the completion set and locked, the well is ready for production. To create a barrier to fluid from escaping the internal bore 24 through the top of the tubing hanger 20, plugs 50 are run into the internal bore 24 and set above the side outlet. Alternatively, a valve located in the internal bore 24 above the side outlet may be operated to the closed position. In the exemplary embodiment, the internal profile of the tubing hanger 20 may include features that allow setting of the plug 50 either above or below the master production port 26. A tree cap 84 may now be installed through the drilling riser or by means of a remotely operated vehicle (ROV). The BOP and riser may then be removed from the multi-section tree 10 and retrieved. Using the hydraulic control line 46, hydraulic fluid may be used to open the downhole SCSSV and allow fluid production to flow from the production tubing 22, through the tubing hanger 20, and into the production port 26 for flow to the surface or any other desired location. Additionally, as shown in FIGS. 3 and 4, the multi-section tree 10 allows for fluid communication from the production tubing 22 annulus below the tubing hanger 20 to the bore of the multi-section tree 10 above the tubing hanger 20. Communication with the production tubing 22 annulus allows for pressure control downhole should pressure in the annulus need to be relieved during production. The fluid communication is controlled using an externally mounted annulus valve 54 that is in fluid communication on one side with a valve section bleed port 52. On the other end, the annulus valve 54 communicates with the annulus below the tubing hanger 20 by connection with a landing section bleed port 60. Also, the multi-section tree 10 includes a back up annulus valve 58 that further connects with an extra, manual connects with an extra, manual annulus block off (not shown). The annulus valve 54 and back up annulus valve 58 may be any appropriate standard API valve. The annulus valve 54 and the back up annulus valve 58 do not need to be externally connected. Instead, as shown in FIG. 4, the annulus valve 54 and back up annulus valve 58 may be connected through an additional port 62 within the valve section 16 and port 64 within the landing section 14.

Also shown in FIGS. 3 and 4, the multi-section tree 10 includes an isolation sleeve 66 that includes seals on its outer surface to form an environment barrier between the inside wall of the landing section 14 and the wellhead 12. Although the isolation sleeve 66 is located in the bore, the annulus surrounding the production tubing 22 is not blocked and fluid is allowed to pass around the orientation tool 28. Another isolation sleeve (not shown) may also be included between the valve section 16 and landing section 14.

At some point in the life of the well, the well may need to be accessed for additional drilling, maintenance, or other reasons. As shown in FIG. 3, to access the well the completion may be pulled from the multi-section tree 10 so that drilling equipment and/or tools may be run into the well. To pull the completion, both the BOP and the riser are installed to the top of the multi-section tree 10. A THRT is run through to the multi-section tree 10 through the riser and engaged with the tubing hanger 20. The lockdown actuator then releases the locking mechanism 48 so that the THRT may retrieve the completion from the multi-section tree 10. Because the passive coupler 40 is a vertical connection, the removal of the tubing hanger 20 disconnects the hydraulic fluid line 36 from the inlet fluid connector 38 of the adapter 34 as the completion is pulled from the multi-section tree 10. With the completion pulled and the well now accessible, work in the well may be performed without also having to pull the multi-section tree 10 from the well. Leaving the multi-section tree 10 in place thus saves considerable time and money for the well operator who does not have to go through the extra steps of removing and then reinstalling the multi-section tree 10 on the wellhead 12. Moreover, the multi-section tree 10, when bifurcated, is lighter than conventional trees, allowing installation with less robust equipment that is generally less expensive.

Figure 6:
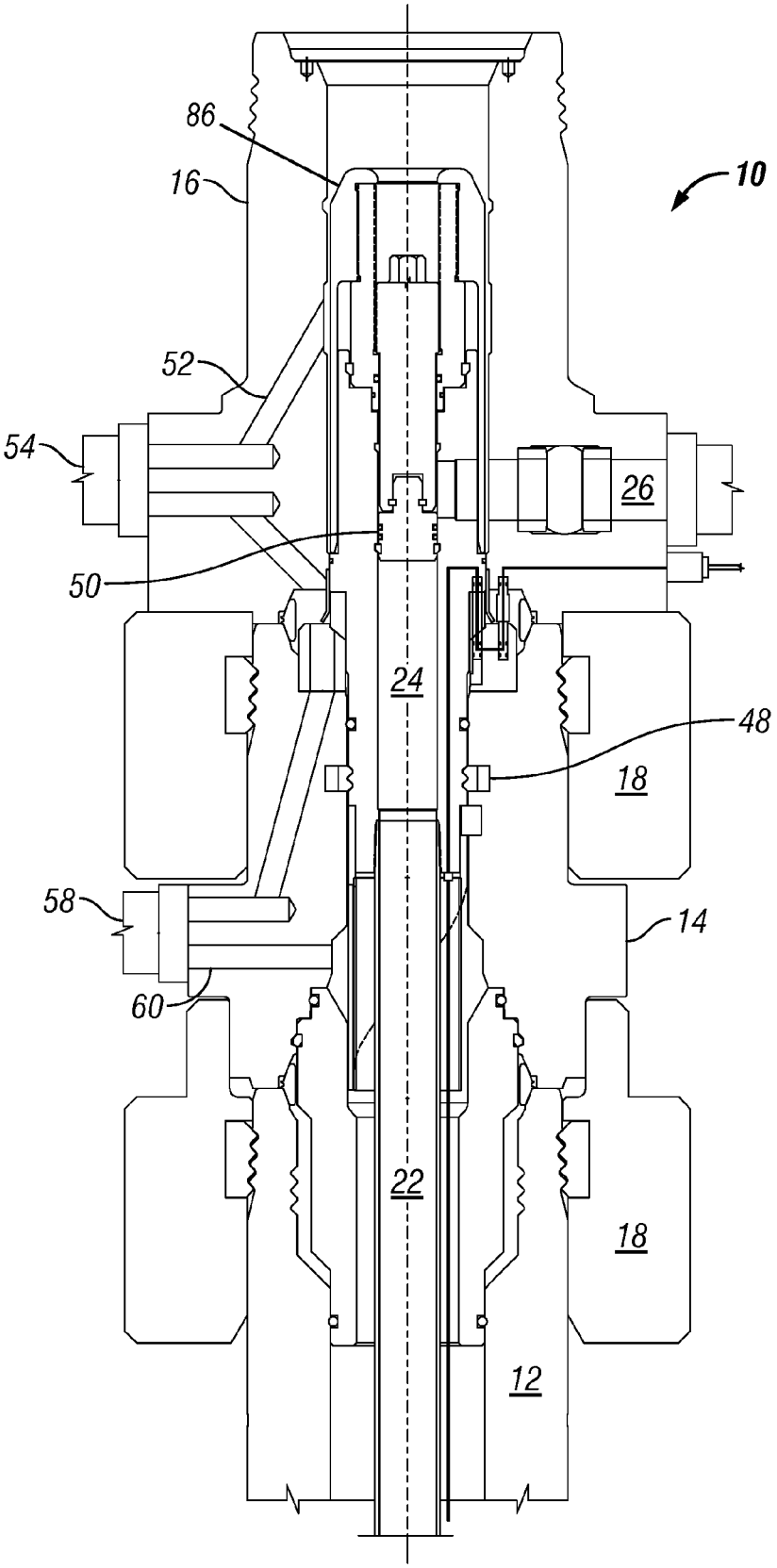
FIG. 6 is a cross section of the multi-section tree of FIG. 5 with a protector installed on the completion.
Figure 7:
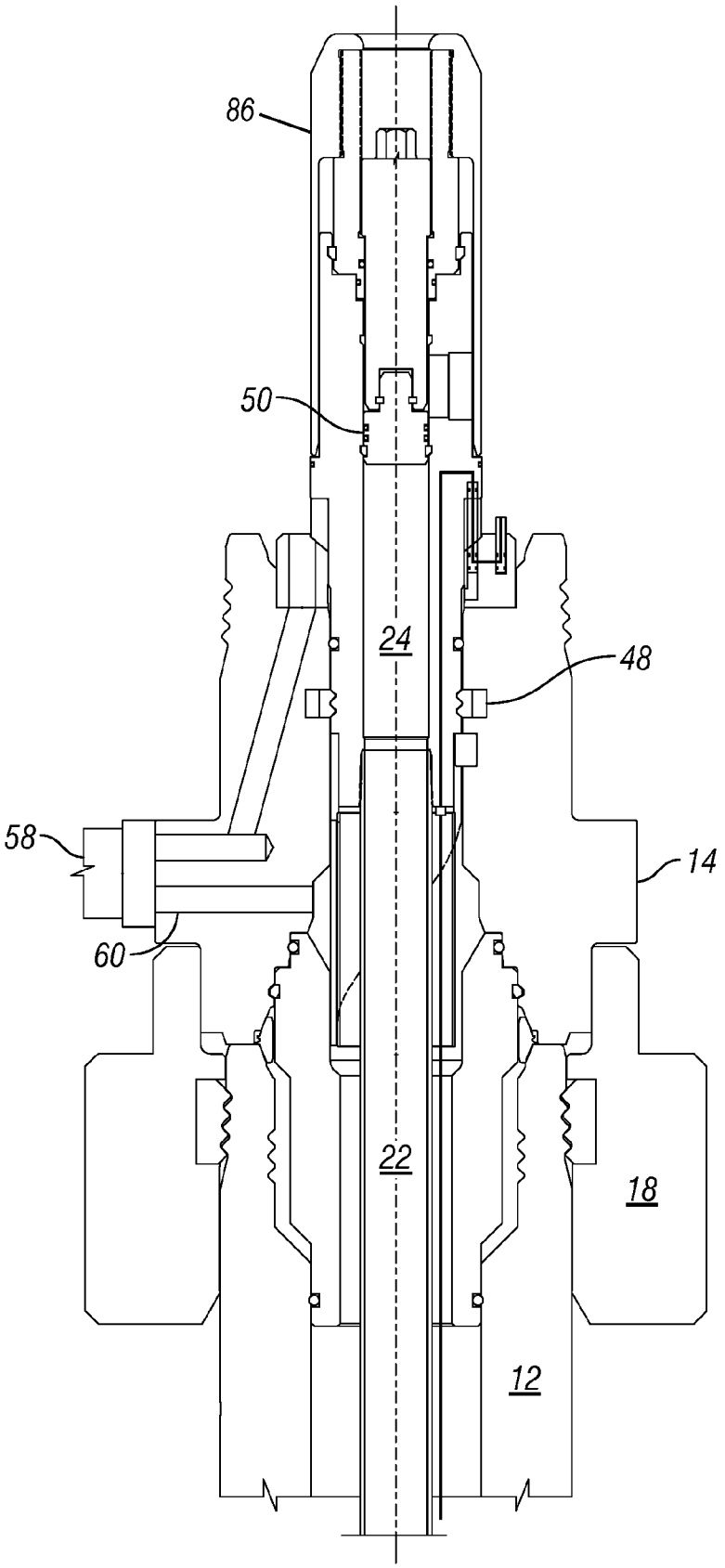
FIG. 7 is a cross section of the multi-section tree with the valve section removed and the completion left installed with the protector.
Figure 8:
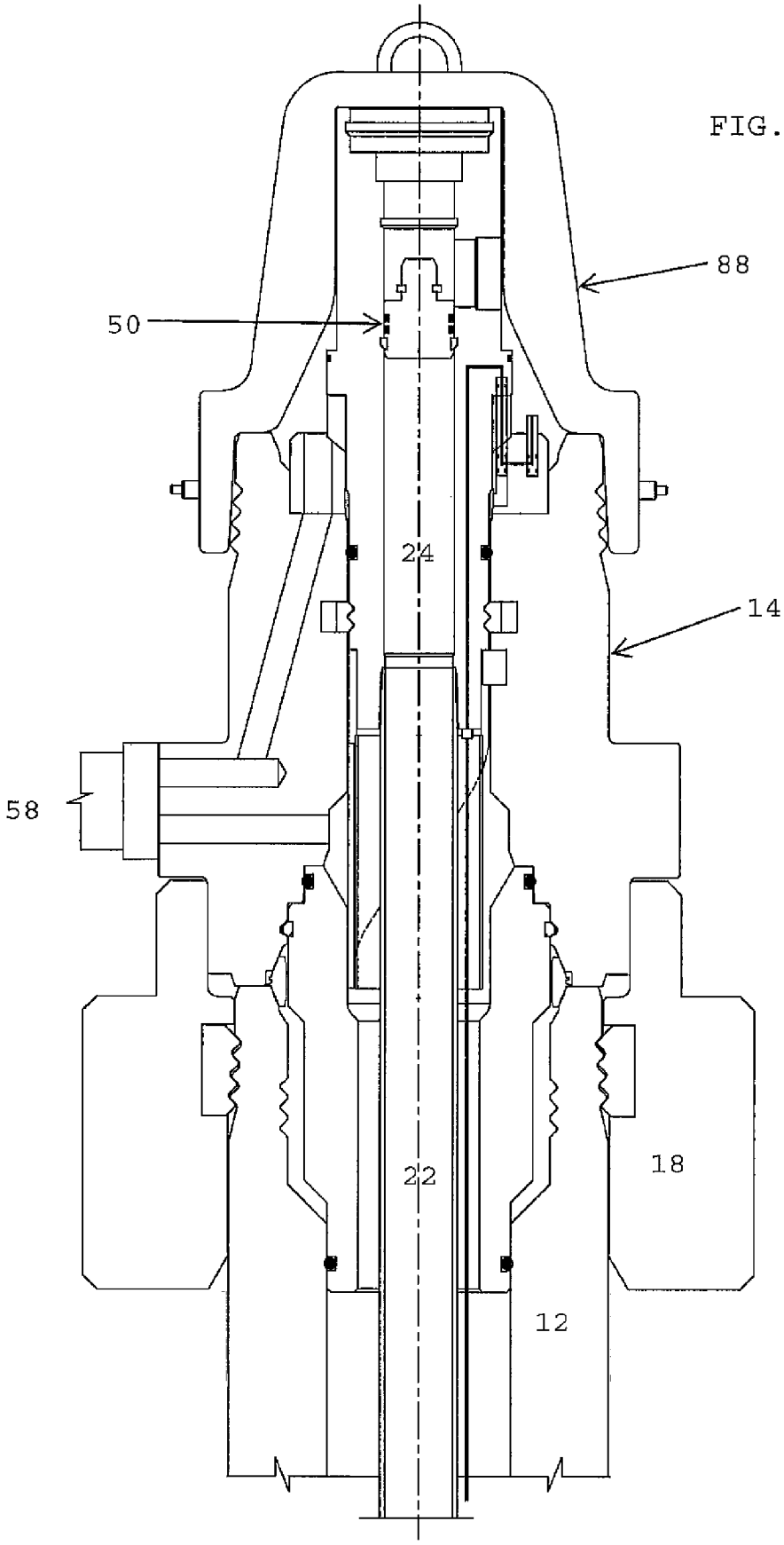
FIG. 8 is a cross section of the multi-section tree with the valve section removed and the completion left installed with a low profile protector.

The same can also be said that at some point in the life of the well, the valves of the multi-section tree 10 may need to be serviced or replaced. As shown in FIGS. 5-8, the valve section 16 may be pulled by itself, leaving the landing section 14 and the completion in place on the wellhead 12. Before the valve section 16 is removed, a second environmental barrier 15 is established in addition to closing the SCSSV in the production bore below the side outlet. The second barrier may be established by ROV interface and/or by access through a completion riser. A preferred method is to close an additional valve located in the production bore below the side outlet using ROV interface to inject hydraulic fluid to the ITC which in turn injects fluid through the tubing hanger and consequently to operate the valve located in the production bore, Alternatively, the ITC may be operated open water by an ROV or by a tool run through a riser and BOP to re-position the plug 50 from above the outlet to below the outlet (FIGS. 4 and 5). If a riser and BOP are attached, plug 50 may be removed and another plug then installed below the side outlet. Unlike when removing the completion, however, the locking mechanism 48 is left in the engaged position. As discussed more fully below, the seals in the tubing hanger 20 on either side of the production port 26 may be included on a removable seal assembly 80 that surrounds the tubing hanger 20. Although not necessary, typically the seal assembly is removed as shown in FIG. 5 and a protector 86 that may be temporary is threaded onto the exposed tubing hanger 20 as shown in FIG. 6.

The hydraulically controlled upper collet connector 18 is then disengaged, and the valve section 16 may then be removed and lifted by attaching an ROV assisted Mechanical Tree Handling Tool coupled to a soft line extending down from a floating vessel, or by the riser and BOP if attached. The design of the coupler 40 allows the vertical separation of the valve section 16 from the landing section 14. The landing section 14 and the completion are left in place on the wellhead 12. With the valve section 16 now retrieved, the service and/or replacement work may be performed without having to pull the landing section 14 and the completion from the well. When the well is not being accessed, the protector 86 may remain in place on the tubing hanger 20. Alternatively, a lower profile protector 88 shown in FIG. 8 may be placed over the tubing hanger 20 and locked into the landing section 14 using any suitable locking engagement. Leaving the landing section 14 and completion in place thus saves considerable time and money for the well operator who does not have to go through the extra steps of removing and then reinstalling the completion just to be able to service the valve section 16.

As previously mentioned and as shown in FIGS. 4-8, the seals in the tubing hanger 20 on either side of the production port 26 may be included on a replaceable seal assembly 80 that surrounds the tubing hanger 20. The seal assembly 80 may also be pulled from the tubing hanger 20 either by itself or in conjunction with pulling the valve section 16 or pulling the tubing hanger 20. The seal assembly 80 includes the seals installed on a retrievable body 82 that slides down over the tubing hanger 20 and is held in place using a tree cap 84 as shown or it's own retention device. The tree cap 84 can be installed above the tubing hanger 20 as a second barrier and/or a second lockdown for the tubing hanger 20. The tree cap 84 can lock to the tree profile and/or the tubing hanger profile and seal to the tree profile, the tubing hanger profile, or both. The tree cap 84 could be ROV installable and retrievable or deployed and removed inside a riser or a combination thereof. The tree cap 84 could also be used to install or retrieve the hanger seal assembly 80 or to shift the seal assembly 80 to another position, e.g., rotate the seal assembly 80 to close off fluid flow into the production port 26. It should also be appreciated that the tree cap 84 may be replaced with any suitable engagement mechanism, such as a threaded connection or lockable dogs engaging a profile on the tubing hanger 20.

Because the locking mechanism 48 is located below the production port 26, the top of the tubing hanger 20 is accessible from the bore of the multi-section tree 10 above the tubing hanger 20. Thus, should the seal assembly 80 need repair or replacement, an appropriate tool or a subsea remote operated vehicle (ROV) may be used to replace the seal assembly 80 without having to pull the entire completion. The ROV may be used to engage the top of the multi-section tree 10 and with the SCSSV set in the closed position, the ROV may remove the seal assembly 80 for repair or replacement.

When the operation is compete, the ROV disengages the multi-section tree 10 and the SCSSV is set to the open position to resume production. With the seal assembly 80 being retrievable from the top of the tubing hanger 20, the service and/or replacement work may be performed without having to pull the completion from the well. Leaving the completion in place thus saves considerable time and money for the well operator who does not have to go through the extra steps of removing and then reinstalling the completion just to be able to service the production production port 26 seals. The seal assembly 80 may be retrieved and re-installed with the tree valve section 16 or with the tubing hanger 20 as they are each individually retrieved or installed as discussed above. The seal assembly 80 may also be retrieved or installed using ROV interface or using a separate tool run through the riser. The seal assembly 80 may also be retrieved or installed by means or assistance of the tree cap 84 as shown, in conjunction with the additional methods just described.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of producing hydrocarbons from a subsea well including:

installing a multi-section production tree on a subsea wellhead at the subsea well, the multi-section production tree including:

a landing section engageable with the subsea wellhead and including a bore; and a valve section separate from and selectively engageable with the landing section and including a bore and a lateral production bore extending through a wall of the valve section;

installing production tubing supported by a tubing hanger into the multi-section production tree such that the tubing hanger lands in the landing section bore and extends from the landing section and into the valve section bore with a lateral production bore of the tubing hanger aligned with the lateral production bore of the valve section; and producing hydrocarbons from the well and out of the multi-section production tree through a production passageway that includes the production tubing and the lateral production bores of the tubing hanger and the valve section.

2. The method of claim 1, wherein installing the multi-section production tree further includes engaging the landing section with the valve section and installing the sections together onto the wellhead.

3. The method of claim 1, wherein installing the multi-section production tree further includes installing the landing section to the wellhead and then engaging the valve section with the landing section at a different time.

4. The method of claim 1, further including controlling an apparatus located downhole in the well from the sea surface by communicating fluid pressure from the surface through a fluid line extending through the wall of the multi-section production tree and downhole to the apparatus.

5. The method of claim 4, further including establishing the fluid line by connecting a fluid line extending through the wall of the multi-section production tree with a fluid line extending downhole to the apparatus using a fluid line connection adapter located in the multi-section production tree.

6. The method of claim 1, further including selectively communicating fluid between the landing section bore below the tubing hanger and the valve section bore above the tubing hanger when the tubing hanger is installed through ports located internally in the valve section and landing section.

7. The method of claim 1, further including retrieving the tubing hanger and production tubing from the multi-section production tree with the valve section remaining engaged with the landing section.

8. The method of claim 7, further including re-installing the tubing hanger and production tubing into the multi-section production tree.

9. The method of claim 1, further including disengaging and removing the valve section from the landing section with the tubing hanger and production tubing remaining installed in the landing section.

10. The method of claim 9, further including re-engaging the valve section with the landing section.

11. The method of claim 9, further including sealing the lateral production of the tubing hanger using a production port seal assembly surrounding the tubing hanger.

12. The method of claim 11, further including removing the production port seal assembly from the tubing hanger with the tubing hanger remaining installed in the valve section.

13. The method of claim 11, further including controlling production through the lateral production ports by selectively rotating the production port seal assembly such that fluid flow between the lateral production ports is closed off.

14. A subsea well production system for a well including a subsea wellhead, the system including:

a multi-section production tree including:

a landing section engageable with the subsea wellhead and including a landing section bore; and a valve section separate from and engageable with the landing section, the valve section including a lateral production port extending through a valve section wall and in communication with a valve section bore;

production tubing supported by a tubing hanger installed and supported in the landing section bore such that the tubing hanger extends from the landing section and into the valve section bore;

the tubing hanger and production tubing being retrievable through the section bores without disengaging the valve section from the landing section; and the valve section being disengageable from the landing section with the tubing hanger remaining in the landing section.

15. The system of claim 14, wherein:

the valve section further includes a tree fluid line;

the apparatus further includes a fluid line connection adapter able to fluidly connect the tree fluid line with a fluid line extending from the tubing hanger downhole into the well; and the tree fluid line extends through and outside the valve section to establish fluid communication from outside the valve section downhole into the well when the fluid lines are connected.

16. The system of claim 14, wherein the valve section and the landing section are installable on the wellhead together or separately.

17. The system of claim 14, the valve section and landing section each further including internal ports allowing selective fluid communication between the landing section bore below the tubing hanger and the valve section bore above the tubing hanger when the tubing hanger is installed.

18. The system of claim 17, wherein fluid communication through the ports is controlled by a valve.

19. The system of claim 14, further including:

the tubing hanger including a lateral production port alignable with the valve section lateral production port; and a production port seal assembly surrounding the tubing hanger inside the valve section and capable of sealing the interface between the lateral production ports of the tubing hanger and the valve section.

20. The system of claim 19, the production port seal assembly further being removable from the tubing hanger while the tubing hanger remains installed in the valve section.

21. The system of claim 19, the production port seal assembly further being selectively rotatable such that fluid flow between the lateral production ports is closed off.

22. The system of claim 15, wherein the fluid line connection adapter includes passive stab connectors able to connect the fluid lines.

23. A subsea well production apparatus for installation on a subsea wellhead for production from a well through production tubing supported by a tubing hanger, the apparatus including:

a landing section engageable with the subsea wellhead and including a landing section bore;

a valve section separate from and engageable with the landing section, the valve section including a lateral production port extending through a valve section wall and in communication with a valve section bore;

the landing section bore being configured to receive and support the tubing hanger such that the tubing hanger extends from the landing section and into the valve section bore;

the landing section and valve section being configured to allow the retrieval of the tubing hanger and production tubing through the section bores without disengaging the valve section from the landing section; and the valve section being disengageable from the landing section with the tubing hanger remaining in the landing section.

24. The apparatus of claim 23, wherein:

the valve section further includes a tree fluid line;

the apparatus further includes a fluid line connection adapter able to fluidly connect the tree fluid line with a fluid line extending from the tubing hanger downhole into the well; and the tree fluid line extends through and outside the valve section to establish fluid communication from outside the valve section downhole into the well when the fluid lines are connected.

25. The apparatus of claim 24, wherein the fluid line connection adapter includes passive stab connectors able to connect the fluid lines.

26. The apparatus of claim 23, wherein the valve section and the landing section are installable on the wellhead together or separately.

27. The apparatus of claim 23, the valve section and landing section each further including internal ports allowing selective fluid communication between the landing section bore below the tubing hanger and the valve section bore above the tubing hanger when the tubing hanger is installed.

28. The apparatus of claim 27, wherein fluid communication through the ports is controlled by a valve.

* * * * *